United States Patent [19]

Mujahid et al.

[11] Patent Number: 4,914,342

[45] Date of Patent: Apr. 3, 1990

[54] NARROW SPOT REFLECTOR LAMP WITH DIFFUSING REFLECTOR

[75] Inventors: Mohammad Mujahid; Harry H. Haft, both of Little Rock, Ark.; William Murray, Somerset, N.J.

[73] Assignee: North American Philips Corp., New York, N.Y.

[21] Appl. No.: 213,962

[22] Filed: Jun. 30, 1988

[51] Int. Cl.[4] ..... H01K 1/28

[52] U.S. Cl. ..... 313/113; 313/116; 362/307; 362/327

[58] Field of Search ..... 313/25, 113, 114, 116; 362/296, 307, 309, 327, 328, 329, 355

[56] References Cited

U.S. PATENT DOCUMENTS

| | | | |
|---|---|---|---|
| 2,810,660 | 10/1957 | Carpenter | 313/116 X |
| 4,339,685 | 7/1982 | Saguchi et al. | 313/113 |
| 4,755,711 | 7/1988 | Fields et al. | 313/113 X |

FOREIGN PATENT DOCUMENTS 2133224 1/1972 Fed. Rep. of Germany .

*Primary Examiner*—Kenneth Wieder

*Attorney, Agent, or Firm*—Emmanuel J. Lobato

[57] ABSTRACT

A narrow spot reflector lamp having a halogen lamp light source. The reflector surface and lens are both stippled and the halogen lamp is shielded so that all of the transmitted light undergoes two diffusions to achieve the desired beam spread.

7 Claims, 3 Drawing Sheets

NARROW SPOT REFLECTOR LAMP WITH DIFFUSING REFLECTOR

BACKGROUND OF THE INVENTION

This invention relates to reflector lamps and more particularly reflector lamps in which the light source is a tungsten-halogen lamp.

Incandescent reflector lamps are well known. This type of lamp comprises an outer lamp envelope, part of which is a reflector surface for reflecting light incident thereon, and an incandescent filament within the outer envelope. The incandescent filament is positioned relative to the reflector surface for illuminating it during lamp operation. The light from the incandescent filament that is incident on the reflector surface is reflected out of the lamp.

A comparatively recent development is the use of a small tungsten-halogen electric lamp as the light source within a reflector lamp. This allows the lamp to have the higher efficacy, higher color temperature and improved maintenance of tungsten-halogen lamps and at the same time have the directional characteristics and light concentrating properties of reflector lamps.

The incorporation of tungsten-halogen lamps into reflector outer envelopes presents size problems, particularly in smaller lamps. Small reflector lamps do not have sufficient depth to easily accommodate the tungsten-halogen lamp, and mechanical interference between the tungsten-halogen lamp and the outer envelope can be a limitation on the size of the reflector lamp.

One solution to the size problem in small reflector lamps has been to make the lens end of the lamp envelope protrude further forward in order to increase the depth of the lamp interior. This permits the tungsten-halogen lamp to be mounted inside the reflector lamp outer envelope, together with associated parts such as a light shield, without any interference with the lamp outer envelope.

It is known to use a diffusing lens in a reflector lamp in order to broaden the light distribution pattern. A lens having stippling or other surface features will cause the light passing through it to become more diffuse. The beam of light from a reflector lamp will be broader the greater the degree of diffusion that is caused by the lamp lens. By using lamp lenses of different degrees of diffusivity, in lamps that are otherwise identical, lamps having different beam widths can be realized.

The lens surface features which define its diffusing properties are permanently molded in the lens in the course of manufacture. Therefore, lenses having different diffusing properties require different molds, even if they are identical in shape and nominal dimensions. The molds are expensive.

Accordingly, it is an object of the invention to provide a reflector lamp design in which the beam width can be increased without any change to the lens design.

It is another object of the invention to provide a narrow spot reflector lamp made of stock components and which uses a tungsten-halogen incandescent lamp as a light source.

SUMMARY OF THE INVENTION

According to the invention a narrow spot reflector lamp is comprised of an outer envelope having a concave reflector surface and a lens covering the reflector surface and joining the reflector surface at its outer edge. The lens has a protruding wall extending forward from the edge of the reflector surface and a stippled dome surface through which light passes out of the lamp.

A light source is positioned within the outer envelope on the lamp axis of symmetry. A light shield within the outer envelope between the light source and the lens dome is positioned and dimensioned to obstruct light from the light source and prevent direct transmission of light from the light source out through the lens. The reflector surface has stippling which is effective for smoothing the spatial distribution of the reflected light to impart to it a narrow spot beam pattern.

In a preferred embodiment the light source is a tungsten-halogen lamp comprised of an envelope and a filament mounted within the halogen lamp. The focal point of the reflector surface is forward of the outer edge of the reflector, and the halogen lamp is mounted with the filament positioned at the focal point of the reflector surface, and the halogen lamp extends into the region bounded by the protruding wall of the lens.

DETAILED DESCRIPTION OF THE INVENTION

Figure 1:
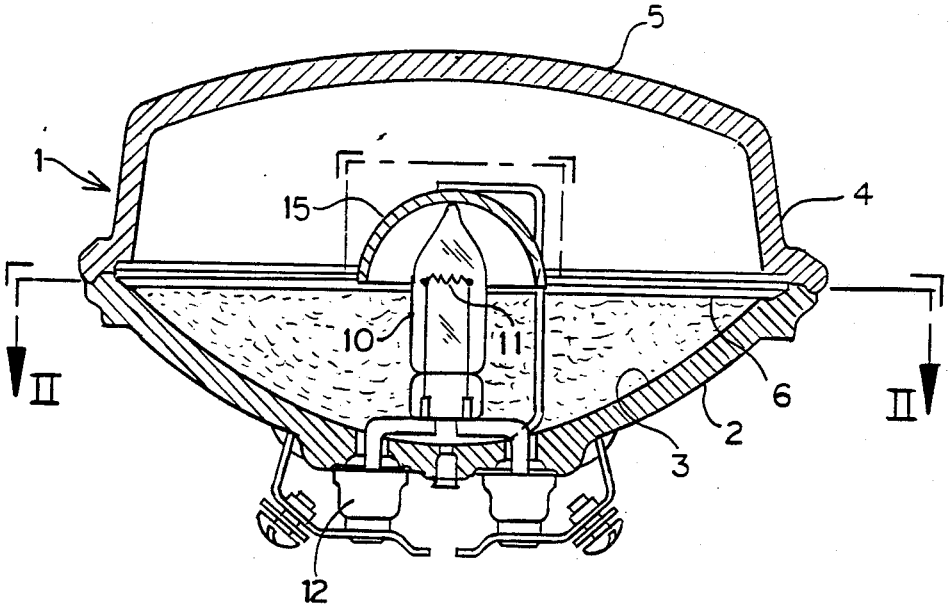
FIG. 1 is a vertical section of a narrow spot reflector lamp according to the invention.

FIG. 1 is a vertical section of a narrow spot reflector lamp 1 according to the invention. The lamp has a glass outer envelope comprised of a back section 2 having a concave reflector surface 3. A very thin reflecting layer, commonly metallic aluminum, is disposed on the reflector surface 3. The thin reflecting layer has the same shape as the reflector surface 3 and is not identified by a separate reference numeral.

For most applications the concave reflector surface 3 is a paraboloid of revolution, although it may have a different shape, such as that of an ellipsoid, if desired. The reflector surface 3 ends at an outer edge 6. An axis of symmetry of the reflector surface is chosen as the axis of symmetry of the lamp. The rear section 2 of the outer envelope is symmetrical about its geometric center.

The lamp outer envelope further comprises a front lens covering the reflector surface 3. The lens has a protruding wall 4 adjacent the outer edge 6 of the reflector surface which protrudes in the forward direction of the lamp, and a dome 5 closing the front of the lamp and covering the reflector surface 3. At least the lens dome 5 is translucent to allow light to exit the lamp through it. Typically, the entire lens is a single piece of glass so that the protruding wall 4 will also be translucent. The lens dome 5 will usually have a fine texture or stippling in order to diffuse light which passes through it. The lens stippling smooths and broadens the beam pattern of the light emitted from the lamp.

A tungsten-halogen incandescent lamp 10 is symmetrically mounted inside the lamp outer envelope on the lamp axis of symmetry. The tungsten-halogen lamp 10 has a horizontal filament 11 positioned at the reflector surface focal point. The focal point of the reflector surface 3 is forward of the outer edge 6 of the reflector surface, and the halogen lamp 10 protrudes into the space defined by the lens protruding wall 4.

A pair of metal ferrules 12 are pressed into the back of the rear section 2 of the reflector lamp envelope. The ferrules 12 are connected to heavy wire lead supports which provide conductive paths to the halogen lamp 10 and mechanically support it within the reflector lamp envelope.

A cup-shaped light shield 15 is positioned between the halogen lamp 10 and the lens domes 5. The shield 15 intercepts all of the direct light from the halogen lamp 10 that would otherwise pass through the reflector lamp lens. The only light that escapes from the reflector lamp is that which is incident on the reflector layer 3 and reflected from it through the lens. As a consequence, the beam spread of the light emitted from the lamp is very narrow.

The lamp structure described up to now was known at the time of the discovery of the present invention. It has been applied to very narrow spot parabolic aluminized reflector (PAR) lamps having a diameter of about 4.5 inches. Lamp size is specified in units of one-eighth inch, and a 4.5 inch PAR lamp is designated PAR 36. A PAR 36 lamp like that described has a beam spread of about 4° to 5° measured between half candlepower points.

It was desired to make PAR 36 lamps of the type just described with a halogen lamp light source, but with an appreciably larger beam spread of at least 8° to 10° to classify them as narrow spot reflector lamps. In order to expand the lamp beam spread a new lens design that is not commercially available would be required. This would involve the manufacture of new molds and considerable expense.

The present invention achieved the desired result, without any modification of the lens, by changing the reflector surface 3 to impart light diffusing properties to it. Because the reflector lamp envelope rear section 2 having such a reflector surface was already commercially available it was possible to realize a narrow spot reflector lamp of the type described without resorting to the manufacture of new molds.

The reflector surface 3 has a surface stippling which is imparted to it by sandblasting the mold surface that form the reflector surface 3. When an aluminum layer is deposited on the reflector surface 3 it acquires a mottled appearance as if covered with a multitude of miniature dune-like irregularities. This appearance is a consequence of minutes surface variations which are a departure from an idealized focussing surface and are effective of the reflected light.

The diffusing properties are caused by the surface geometry of the reflective surface 3 on which the aluminum reflecting layer is disposed, and not by any stippling or other treatment of the reflecting side of the aluminum layer itself. Consequently, its reflectivity is not diminished. The result is a narrow spot reflector lamp having a beam spread of the order of 10° that is achieved without the necessity of the new lens design.

Figure 2:
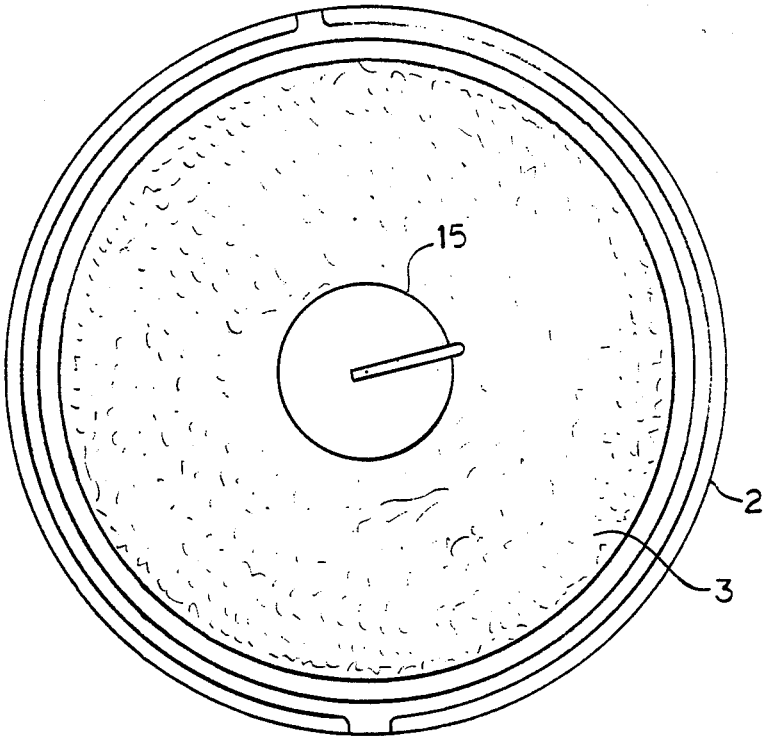
FIG. 2 is a partial cross-section of the narrow spot reflector lamp shown in FIG. 1.

FIG. 2 is a partial cross-section of the lamp according to the invention illustrated in FIG. 1. It shows the effect of the stippling on the underlying reflector surface 3. The light shield 15 obstructs light from the halogen lamp filament 11. Only reflected light leaves the lamp and all of the light reflected forward by the reflecting layer undergoes diffusion as it is reflected. Further diffusion occurs as the light passes through the reflector lamp lens and the desired beam spread is achieved.

EXAMPLE

A PAR 36 lamp was made having the structure illustrated in FIG. 1. The reflector layer 3 has a focal length of one inch and is a paraboloid of revolution. A 50 watt tungsten-halogen lamp with a horizontal filament is mounted with the filament at the focal point. The cup-shaped light shield 15 is approximately hemispherical with a diameter of approximately 1.2 inches and is mounted with its lower edge slightly below the lamp filament. The reflector surface 3 is stippled so that the reflecting layer will diffuse reflected light. The rear section 2 of the reflector lamp outer envelope is available from Corning Glass Works, Part No. 154042-3.

Figure 3:
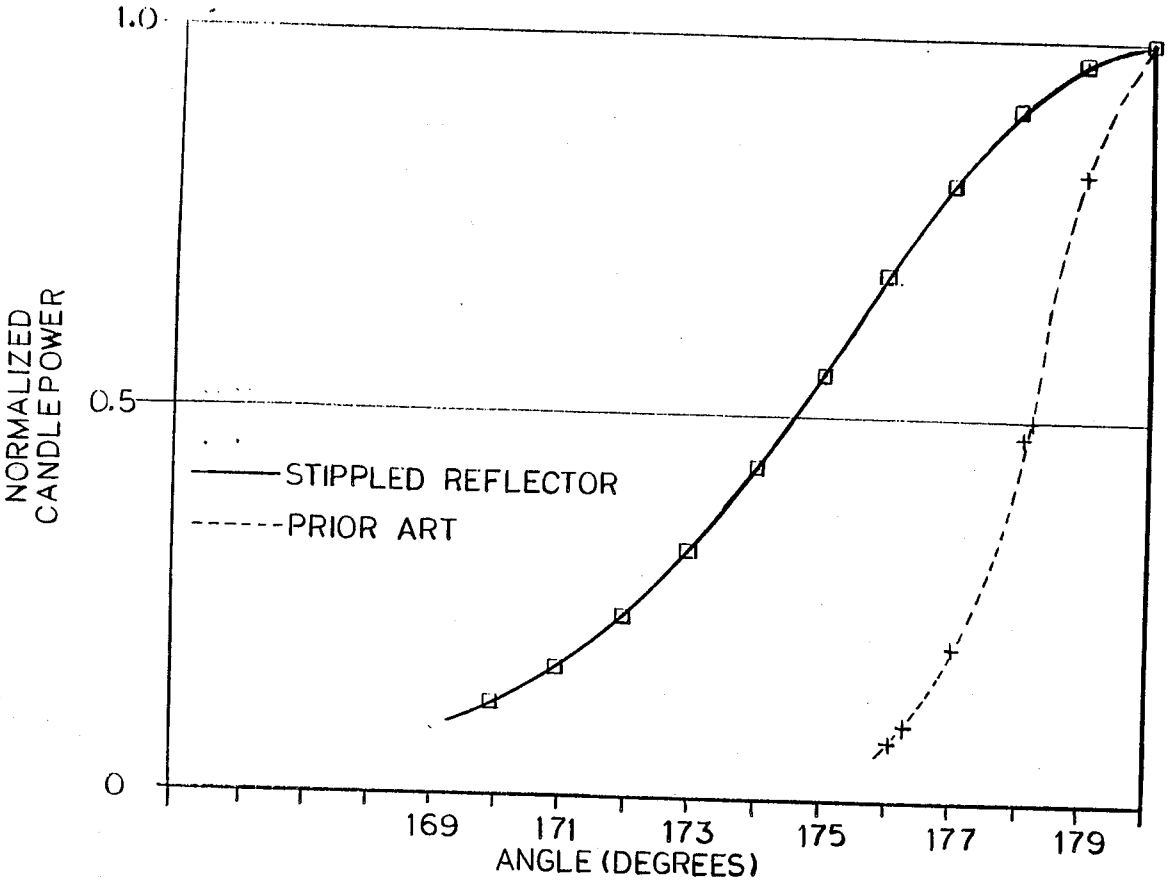
FIG. 3 is a graph of the beam pattern of the narrow spot reflector lamp shown in FIG. 1 and a prior art reflector lamp, which illustrates the increased beam spread of the invention.

The lamp according to the invention was compared with a lamp identical in every respect, except that the reflector layer 3 was without stippling so that the reflecting coating was non-diffusing. The light intensity distribution for the two lamps, expressed in arbitrary units of candlepower, is shown in FIG. 3. The curves are normalized so that their maxima coincide. The lamp according to the invention has a beam spread of approximately 10°, compared with the approximate 4° beam spread of the prior art lamp. This data establishes the effectiveness of a light diffusing reflector in the lamp according to the invention and its ability to realize a narrow spot reflector lamp using commercially available components.

What is claimed:

1. In a narrow spot reflector lamp of the type comprising an outer envelope having a concave reflector surface terminating at an outer edge and a lens covering said reflector surface, wherein said lens has a protruding wall extending forward from the outer edge of said reflector surface and a stippled dome surface, a light source within said outer envelope on the lamp axis of symmetry, a light shield within said outer envelope between said light source and said lens dome and positioned and dimensioned to obstruct light from said light source and prevent direct transmission of light from said light source out of said lens dome, the improvement comprising, the entire reflector surface having stippling effective for smoothing the spatial distribution of light reflected therefrom;

said light shield being effective to prevent any light from passing directly through said lens; and all of the light from said lamp undergoing a first diffusion upon reflection and a second diffusion upon passing through said lens.

2. In a narrow spot reflector lamp according to claim 1, wherein said light source is a tungsten-halogen lamp comprised of an envelope and a filament mounted within said envelope;

the focal point of said reflector surface is forward of said reflector surface outer edge; and said tungsten-halogen lamp is mounted with said filament positioned at the focal point of said reflector surface and said tungsten-halogen lamp extends into the region bounded by the said protruding wall of said lens.

3. In a narrow spot reflector lamp according to claim 1, wherein said stippled reflector surface and said lens are effective to impart to the reflector lamp a beam spread greater than about nine degrees.

4. In a narrow spot reflector lamp according to claim 1, said outer envelope having a concave surface portion molded from a roughened mold surface, and said reflector surface comprised of a reflective layer disposed on said concave surface portion and having stippling imparted to it by said underlying concave surface portion molded from a roughened mold surface.

5. In a narrow spot PAR 36 lamp of the type comprising an outer envelope having a concave parabolic reflector surface having a focal distance of approximately one inch and a lens covering said reflector surface, wherein said lens has a protruding wall extending forward from the edge of the reflector surface and a stippled dome surface, a tungsten-halogen lamp positioned within the outer envelope on the lamp axis of symmetry, wherein said tungsten-halogen lamp is comprised of an envelope and a filament mounted within said envelope, and said tungsten-halogen lamp is positioned with said filament on the lamp axis of symmetry approximately one inch from said reflector surface, a light shield within said outer envelope between said tungsten-halogen lamp and said lens dome and positioned and dimensioned to obstruct light form said tungsten-halogen lamp and prevent direct transmission of light out of said lens, the improvement comprising: the entire reflector surface having an optically diffusing surface effective to diffuse reflect light;

said light shield is effective to prevent any light to pass directly through said lens; and all of the light from said lamp undergoes a first diffusion upon reflection and a second diffusion upon passing through said lens to increase the lamp beam spread to at least about eight to ten degrees.

6. In a narrow spot PAR 36 lamp of the type according to claim 5, the focal point of said reflector surface is forward of the edge of said reflector surface;

said tungsten-halogen lamp is mounted with said filament positioned at the focal point forward of said reflector surface; and said shield is cup-shaped and covering an end of said tungsten-halogen lamp and curved downward to extend beyond said filament in the direction of said reflector surface.

7. In a narrow spot reflector lamp according to claim 5, said outer envelope having a concave surface portion molded from a roughened mold surface, and said reflector surface comprised of a reflective layer disposed on said concave surface portion and having stippling imparted to it by said underlying concave surface portion molded from a roughened mold surface.

* * * * *